US005820408A

United States Patent [19]

Wang

[11] Patent Number: 5,820,408

[45] Date of Patent: Oct. 13, 1998

[54] MALE COAXIAL CABLE CONNECTOR

[76] Inventor: Tsan-chi Wang, 4th Floor, No. 8, Alley 8, Lane Ssu-Wei, Chung Cheng Rd., Hsin-Tien City, Taipei Hsien, Taiwan

[21] Appl. No.: 792,514

[22] Filed: Jan. 31, 1997

[30] Foreign Application Priority Data

Sep. 23, 1996 [TW] Taiwan ..... 85214685

[51] Int. Cl.[6] ..... H01R 9/05

[52] U.S. Cl. ..... 439/578; 439/610

[58] Field of Search ..... 439/578–585, 439/675, 668, 610

[56] References Cited

U.S. PATENT DOCUMENTS 5,454,736 10/1995 Chou ..... 439/578

*Primary Examiner*—Khiem Nguyen
*Assistant Examiner*—Eugene G. Byrd
*Attorney, Agent, or Firm*—Fish & Richardson P.C.

[57] ABSTRACT

A male coaxial cable connector including an insulating barrel, a metal casing, a signal terminal, and a metal cap. The metal casing is a stepped cylinder. The insulating barrel is a hollow cylinder fitted into the front end of the metal casing. The signal terminal is fitted into the insulating barrel, having one end terminating in longitudinal clamping strips, an opposite end terminating in a head, and a cylindrical receiving chamber longitudinally extended to the head for receiving the central conductor of the coaxial cable. The metal cap is a stepped cylinder having a front section sleeved onto the rear section of the metal casing to hold down the braided outside conductor of the coaxial cable.

5 Claims, 6 Drawing Sheets

MALE COAXIAL CABLE CONNECTOR

BACKGROUND OF THE INVENTION

1. Field of the Invention:

The present invention relates to coaxial cable connectors, and more specifically to a male coaxial cable connector adapted for fastening to one end of a coaxial cable for connection to a female coaxial cable connector.

2. Description of the Prior Art:

A variety of coaxial cable connectors have been disclosed. Being easy to be installed in a coaxial cable is the main factor to be taken into account when designing a coaxial cable connector. FIG. 1 shows a male coaxial cable connector according to the prior art (U.S. Pat. No. 5,454,736, issued on Oct. 3, 1995). This structure of male coaxial cable connector comprises a metal casing 92, a tubular insulator 91 mounted within the metal casing, a signal terminal 94 inserted into the insulator 91 inside the metal casing 92 and having a clamping end 941 fastened to the central conductor of the coaxial cable 95, and a metal cap 93 fastened to one end of the metal casing 92 to hold down the coaxial cable 95. Conventional male coaxial cable connectors are commonly of this design. The present invention is also similar to this structure of male coaxial cable connector. However, there is still strong demand to have a male coaxial cable connector which can be conveniently fastened to the coaxial cable by an automatic mounting machine, and the parts of which can be made by a less expensive method. For example, in the male coaxial cable connector of U.S. Pat. No. 5,454,736, the complicated procedure of fastening the clamping end 941 of the signal terminal 94 to the central conductor of the coaxial cable 95 tends to cause a high defective rate during a fast mass production.

SUMMARY OF THE INVENTION

The present invention has been accomplished under the circumstances in view. It is one object of the present invention to provide a male coaxial cable connector which is suitable for mass production. It is another object of the present invention to provide a male coaxial cable connector which is easy to assemble. It is still another object of the present invention to provide a male coaxial cable connector which can be quickly fastened to a coaxial cable. To achieve these and other objects of the present invention, there is provided a male coaxial cable connector comprised of an insulating barrel, a metal casing, a signal terminal, and a metal cap. The metal casing is a stepped cylinder. The insulating barrel is a hollow cylinder fitted into the front end of the metal casing. The signal terminal is fitted into the insulating barrel, having one end terminating in longitudinal clamping strips, an opposite end terminating in a head, and a cylindrical receiving chamber longitudinally extended to the head for receiving the central conductor of the coaxial cable. The metal cap is a stepped cylinder having a front section sleeved onto the rear section of the metal casing to hold down the braided outside conductor of the coaxial cable. Because the component parts of the male coaxial cable connector have a respective cylindrical profile, the molds required are simple and can achieve a high precision, the demand for a particular impedance can be easily achieved, the defective rate of finished products can be greatly reduced. When the component parts of the male coaxial cable connector are assembled, they provide a smooth outside surface, therefore the male coaxial cable connector does not hurt the user.

DETAILED DESCRIPTION OF THE PREFERRED EMBODIMENT

Figure 1:
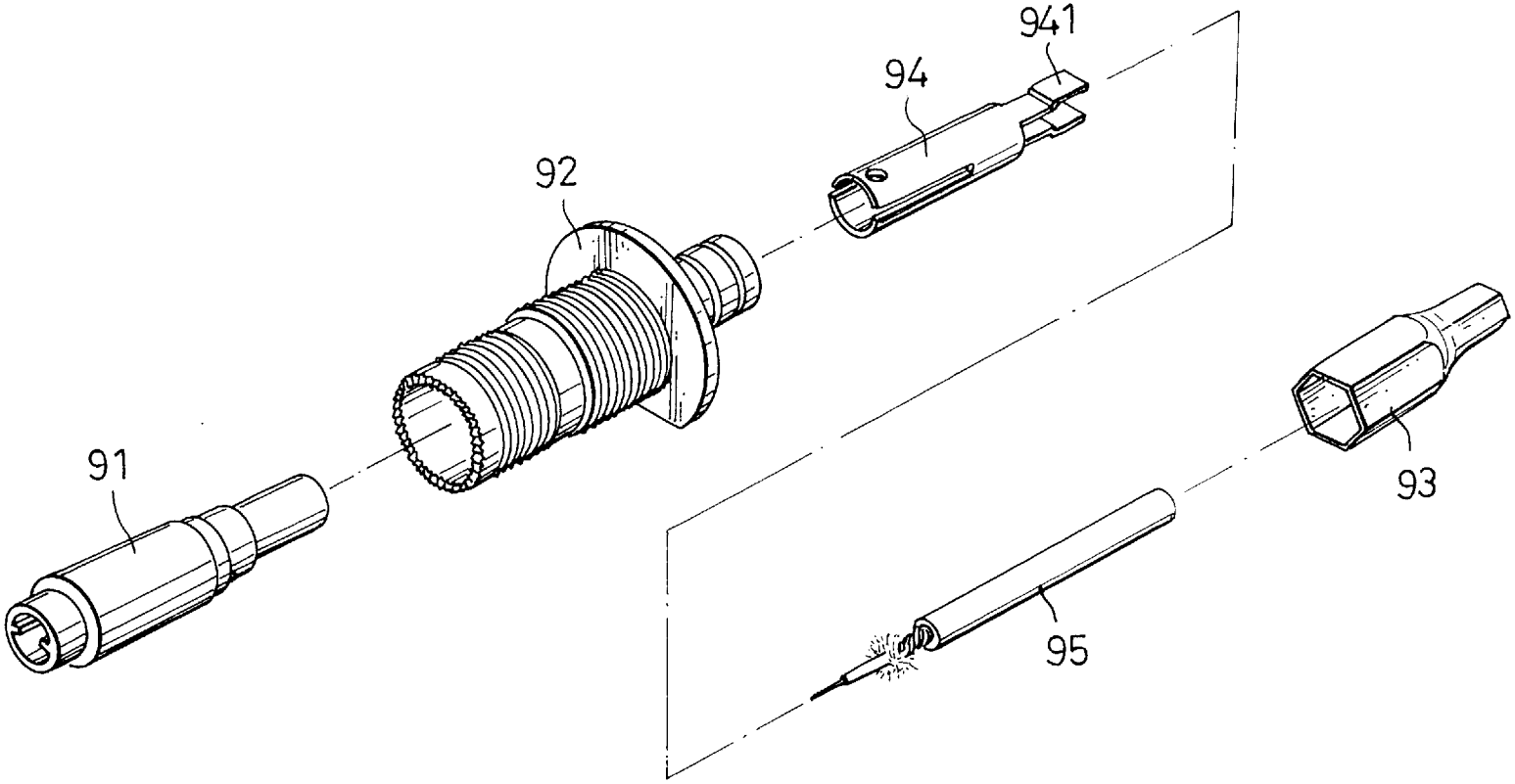
FIG. 1 PRIOR ART
FIG. 1 is an exploded view of a male coaxial cable connector according to the prior art.
Figure 2:
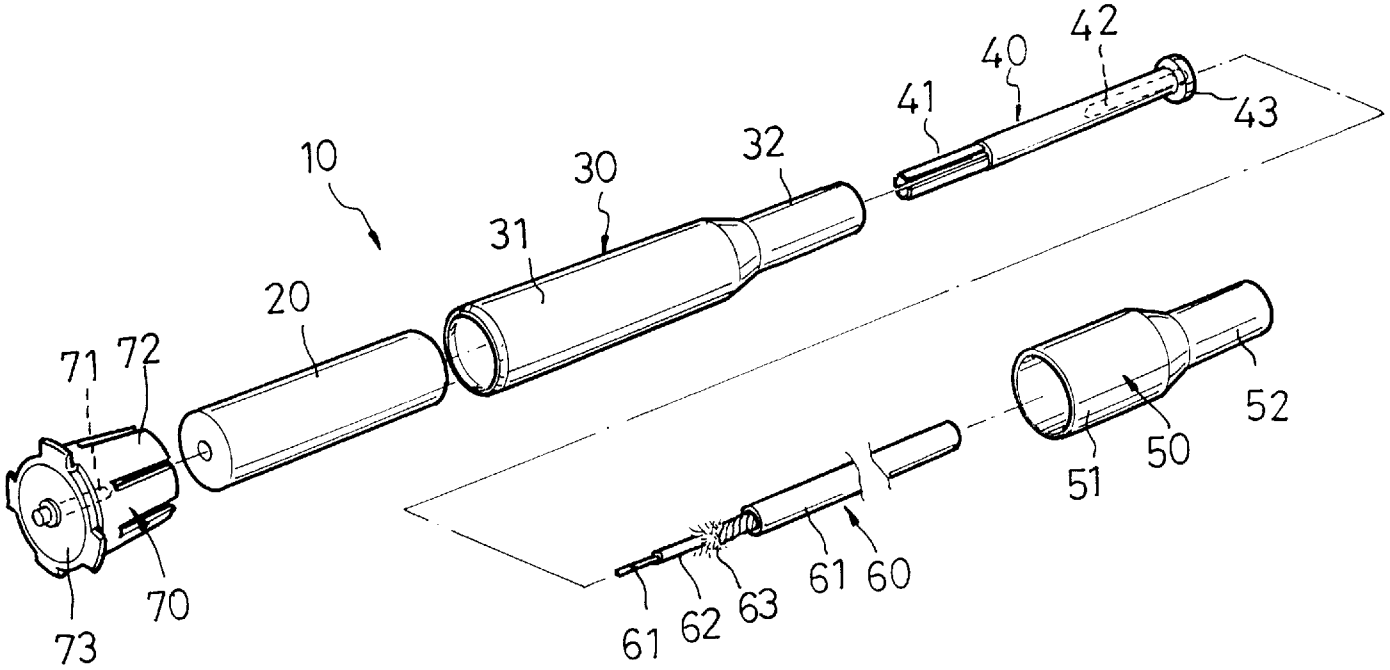
FIG. 2 is an exploded view of a male coaxial cable connector according to one embodiment of the present invention.

Referring to FIG. 2, the male coaxial cable connector, referenced by 10, is comprised of an insulating barrel 20, a metal casing 30, a signal terminal 40, and a metal cap 50, and adapted for fastening to one end of a coaxial cable 60 for connection to a coaxial cable receptacle. The coaxial cable 60 comprises an insulator 64, a braided outside conductor 63 surrounded by the insulator 64, an insulating medium 62 surrounded by the braided outside conductor 63, and a central conductor 61 surrounded by the insulating medium 62.

The metal casing 30 is substantially shaped like a stepped cylindrical, comprising a cylindrical front section 31 and a cylindrical rear section 32 longitudinally connected together. The inner diameter and outer diameter of the front section 31 are bigger than that of the rear section 32. The insulating barrel 20 is a hollow cylinder fitting the inner diameter of the front section 31 of the metal casing 30.

The signal terminal 40 has one end terminating in a plurality of for example four longitudinal springy clamping strips 41, an opposite end terminating in a head 43, and a cylindrical receiving chamber 42 longitudinally disposed at one end and extended to the center of the head 43. The diameter of the cylindrical receiving chamber 42 is equal or approximately equal to the diameter of the central conductor 61 of the coaxial cable 60. The diameter of the signal terminal 40 is equal or approximately equal to the inner diameter of the insulating barrel 20, so that the signal terminal 40 can be fitted into the insulating barrel 20. The diameter of the head 43 of the signal terminal 40 is bigger than the inner diameter of the insulating barrel 20, therefore the head 43 is stopped outside the insulating barrel 20 at one end when the signal terminal 40 is fitted into the insulating barrel 20.

The metal cap 50 is a stepped hollow cylinder comprised of a front section 51 and a rear section 52. The diameter of the front section 51 is bigger than that of the rear section 52. The inner diameter of the front section 51 is equal or approximately equal to the outer diameter of the rear section 32 of the metal casing 30, so that the rear section 32 of the metal casing 30 can be fitted into the front section 51 of the metal cap 50. The outer diameter of the front section 51 of the metal cap 50 is equal or approximately equal to the outer diameter of the front section 31 of the metal casing 30, therefore the front section 31 of the metal casing 30 and the front section 51 of the metal cap 50 are disposed in a flush manner when the front section 51 of the metal cap 50 is sleeved onto the rear section 32 of the metal casing 30. Further, the front end of the front section 31 of the metal casing 30 has a bevel edge 311 (see FIG. 4). Through the bevel edge 311, the male coaxial cable connector 10 can be conveniently plugged into a matching female coaxial cable connector.

Figure 3:
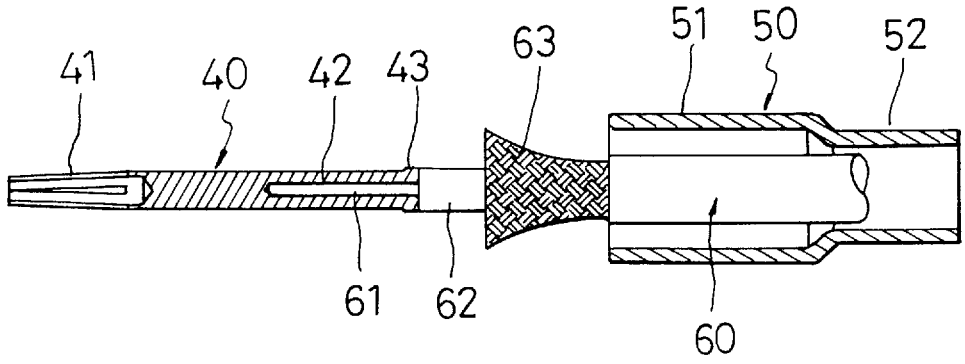
FIG. 3 is a sectional view showing the coaxial cable inserted through the metal cap, and the central conductor of the coaxial cable inserted into the cylindrical receiving chamber of the signal terminal according to the present invention.
Figure 4:
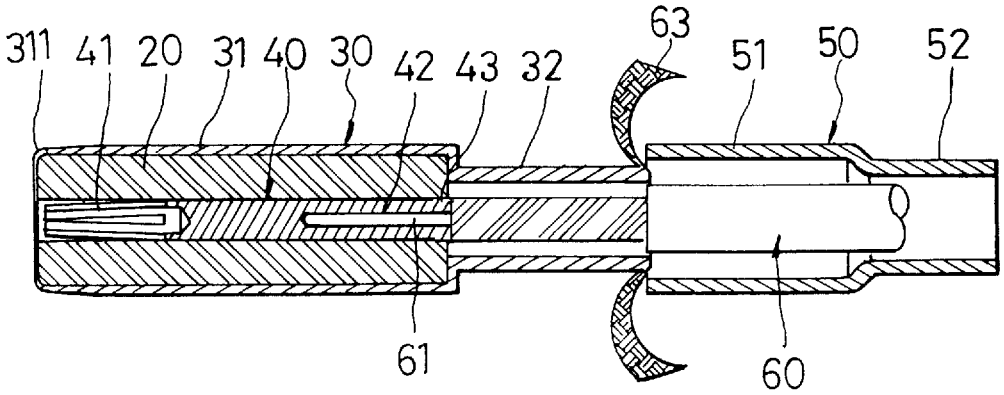
FIG. 4 is another sectional view of the present invention, showing the signal terminal fitted into the insulating barrel inside the metal casing.

The installation procedure of the coaxial cable 60 in the male coaxial cable connector 10 is outlined hereinafter with reference to FIGS. 3 and 4. The lead end of the coaxial cable 60 is processed into the form shown in FIG. 2, and the length of the exposed lead end of the central conductor 61 is preferably maintained at about equal to the length of the cylindrical receiving chamber 42 of the signal terminal 40. When the lead end of the coaxial cable 60 is properly processed, the coaxial cable 60 is inserted through the metal cap 50, permitting the central conductor 61 to be inserted into the cylindrical receiving chamber 42 of the signal terminal 40. Then, the insulating barrel 20 is fitted into the front section 31 of the metal casing 30, and then the braided outside conductor 63 is stripped from the insulating medium 62, and then the signal terminal 40 is inserted into the insulating barrel 20 inside the metal casing 30. Because the signal terminal 40 has a head 43 at one end, the signal terminal 40 can be conveniently installed in the insulating barrel 20 inside the meal casing 30 by an automatic mounting machine, without causing the signal terminal 40 to project out of the metal casing 30. Then, the stripped insulator 63 is covered over the rear section 32 of the metal casing 30, and then the metal cap 50 is sleeved onto the rear section 32 of the metal casing 30 to hold down the coaxial cable 60.

Figure 5:
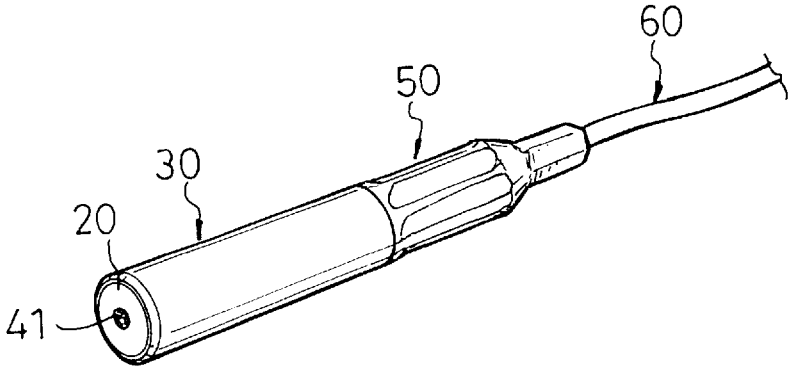
FIG. 5 is an elevational assembly view of the male coaxial cable connector shown in FIG. 2.

FIG. 5 shows the present invention assembled. When assembled, the front section 51 of the metal cap 50 and the front section 31 of the metal casing 30 are maintained in a flush manner, therefore the smooth outside wall of the assembly does not hurt the user.

Figure 6:
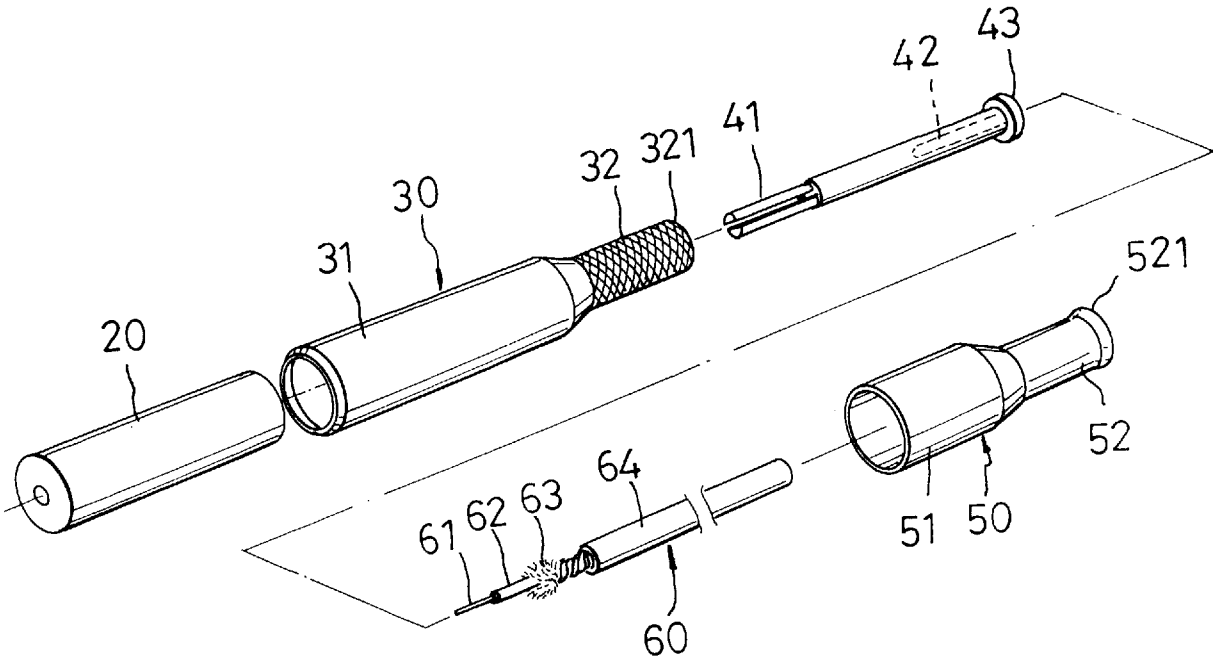
FIG. 6 is an exploded view of a male coaxial cable connector according to an alternate form of the present invention.
Figure 7:
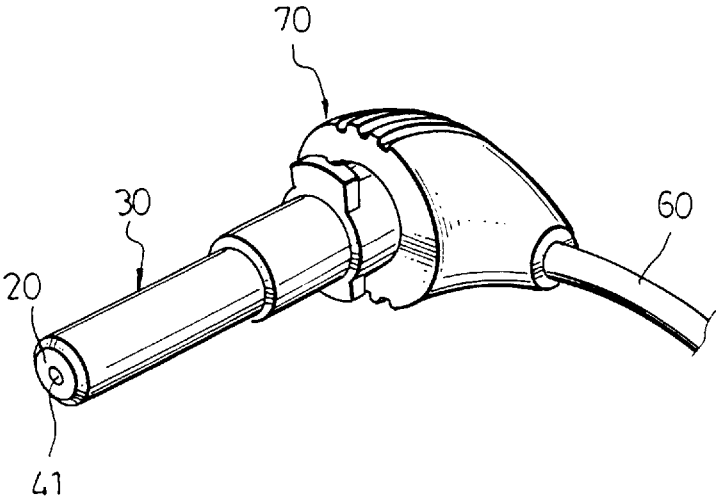
FIG. 7 is an elevational assembly view of the male coaxial cable with a handle installed.

FIG. 6 shows an alternate form of the present invention. According to this alternate form, the rear section 32 of the metal casing 30 has an embossed outside wall 321 (the pattern of the embossed outside wall 321 can be formed of intersected lines, tooth-like raised portions and recessed portions, etc.), so that the braided outside conductor 63 of the coaxial cable 60 can be firmly retained between the rear section 32 of the metal casing 30 and the front section 51 of the metal cap 50. Further, the rear section 52 of the metal cap 50 may has an expanded end 521. Therefore, when a handle 70 (see FIG. 7) is installed on the metal cap 50, the handle 70 is hard to be disconnected from the rear section 52 of the metal cap 50.

It is to be understood that the drawings are designed for purposes of illustration only, and are not intended as a definition of the limits and scope of the invention disclosed.

What the invention claimed is:

1. A male coaxial cable connector connected to one end of a coaxial cable having a braided outside conductor surrounded by an insulator and a central conductor surrounded by an insulating medium within said braided outside conductor, the male coaxial cable connector comprising:

a metal casing substantially shaped like a stepped cylinder and having a cylindrical front section and a cylindrical rear section longitudinally connected to the front section, the front section of said metal casing having a diameter larger than that of the rear section thereof;

a hollow cylinder insulating barrel fitted into the front section of said metal casing and having an opening extending therethrough;

a signal terminal inserted into said opening of said insulating barrel fitted within said metal casing, said signal terminal having a plurality of longitudinal springy clamping strips at one end and a head at the other end, said head dimensioned larger than the opening of said hollow cylinder insulating barrel, so that the head is positioned against one end of said insulating barrel within said metal casing, said signal terminal having a cylindrical receiving chamber longitudinally disposed at one end and extending to said head; and a metal cap fastened to said metal casing to hold down said coaxial cable, said metal cap comprising a front section sleeved onto the rear section of said metal casing, and disposed in a flush manner with the front section of said metal casing to hold down the braided outside conductor of said coaxial outside the rear section of said metal casing.

2. The male coaxial cable connector of claim 1, futher including:

wherein the front section of said metal casing has a bevel front edge.

3. The male coaxial cable connector of claim 1 wherein the rear section of said metal casing has an embossed outside wall.

4. The male coaxial cable connector of claim 1 wherein the rear section of said metal cap has an expanded rear end.

5. The male coaxial cable connector of claim 1 further comprise a handle which is connected with said metal cap.

* * * * *